United States Patent [19]

Zimmern

[11] Patent Number: 4,571,166

[45] Date of Patent: Feb. 18, 1986

[54] CONTROL SLIDE FOR A SCREW VOLUMETRIC MACHINE AND A MACHINE EQUIPPED THEREWITH

[76] Inventor: Bernard Zimmern, 27 rue Delabordère, Neuilly-sur-Seine 92200, France

[21] Appl. No.: 491,474

[22] Filed: May 4, 1983

[30] Foreign Application Priority Data

May 12, 1982 [FR] France ..... 82 08235

[51] Int. Cl.[4] ..... F01C 3/08; F01C 1/08

[52] U.S. Cl. ..... 418/195; 418/201

[58] Field of Search ..... 418/195, 196, 197, 201; 137/625.48, 269; 251/121, 205, 324, 356; 417/440

[56] References Cited

U.S. PATENT DOCUMENTS 3,088,659 5/1963 Nilsson ..... 418/159

4,074,957 2/1978 Clarke ..... 418/195

FOREIGN PATENT DOCUMENTS 2321613 8/1976 France .

*Primary Examiner*—Carlton R. Croyle

*Assistant Examiner*—Jane E. Obee

*Attorney, Agent, or Firm*—Ziems, Walter & Shannon

[57] ABSTRACT

A compressor comprises an hour-glass screw meshing with a pinion-wheel and a slide operable to obstruct partly a discharge port so as to increase the compression ratio by delaying the discharge moment. An edge of a part of the slide is used to obstruct the discharge cavity. The other edge of this part is provided with a removable spacer hvaing a thickness adapted to fill the slide-groove for a given adjustment of the slide. If the slide is moved so as to vary the compression ratio, a spacer having another thickness may be mounted to avoid modifying the volumetric capacity.

2 Claims, 6 Drawing Figures

CONTROL SLIDE FOR A SCREW VOLUMETRIC MACHINE AND A MACHINE EQUIPPED THEREWITH

The present invention relates to a control slide for a volumetric machine of the type provided with an hour-glass screw, and especially a machine acting as a compressor.

The invention also relates to a machine, especially a compressor, using such a slide.

The above-cited compressors comprise an hour-glass screw with a cylindrical outer profile, located inside a leak-tight cylindrical casing and cooperating with a plane pinion-wheel in order to create compression chambers, each of them formed by the walls of two consecutive threads, the wall of the casing and one face of one tooth of the pinion-wheel. One low pressure port is provided through the casing near one end of the screw, and one high pressure port is provided near the other end of the screw.

The French patent No. 76 25 431 teaches mounting a slide disposed inside a groove machined in the casing, parallel to the axis of the screw. This slide is flush with the internal wall of the casing and is movable parallel to the axis of the screw, so as to obstruct partly the high pressure port and to delay more or less the time of discharge, which permits increasing the compression ratio. However, during this displacement, the other extremity of the slide uncovers a cavity inside the casing, which, via conduits, returns to the low pressure a portion of gas at the beginning of its compression, thus reducing the volumetric capacity of the compressor.

Now, it may be desired to increase the compression ratio while keeping the same volumetric capacity. This is the case, for instance, of refrigeration compressors according to the seasons or of natural gas fields coming to exhaustion.

One solution could consist in the use of interchangeable slides of different length. However, in order to obtain leak-tight cooperation with the screw and a perfect flush fit of the slide with the casing, the casing and the slide are machined together, which makes the interchangeable slide solution unpracticable.

The object of the invention is to provide a slide which would without any drawbacks permit varying the compression ratio of the volumetric machine.

Such a result is obtained, according to the invention, by the slide comprising, at its end situated in the vicinity of the low pressure port, a detachable spacer slid on a rod of the slide and secured by screws.

Depending on the removable part being present or not, one obtains a slide either shorter or longer. In both cases, the remaining part of the slide is the one which has been machined at the same time as the casing and, thus, which presents the required quality of leak-tightness. Therefore, the problem of changing slides is solved.

The location of the spacer in the vicinity of the low pressure means that, without any drawbacks, this additional spacer does not need a specially accurate leak-tightness.

According to another aspect of the invention, the volumetric machine, especially a compressor, comprising an hour-glass screw with a cylindrical outer profile, located inside a leak-tight casing and cooperating with a plane pinion-wheel, also comprises a control slide according to the above-mentioned specification.

Further details and advantages of the invention will be more readily understood from the detailed description given hereinafter.

In the accompanying drawings, given by way of nonlimitative examples:

Figure 1:
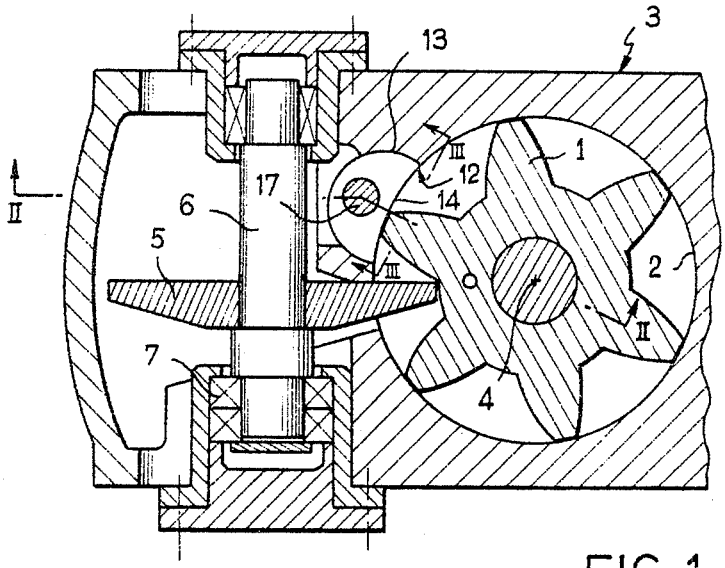
FIG. 1 is a sectional view, perpendicular to the axis of the screw, of a compressor provided with a slide according to the invention, along I—I of FIG. 2.
Figure 2:
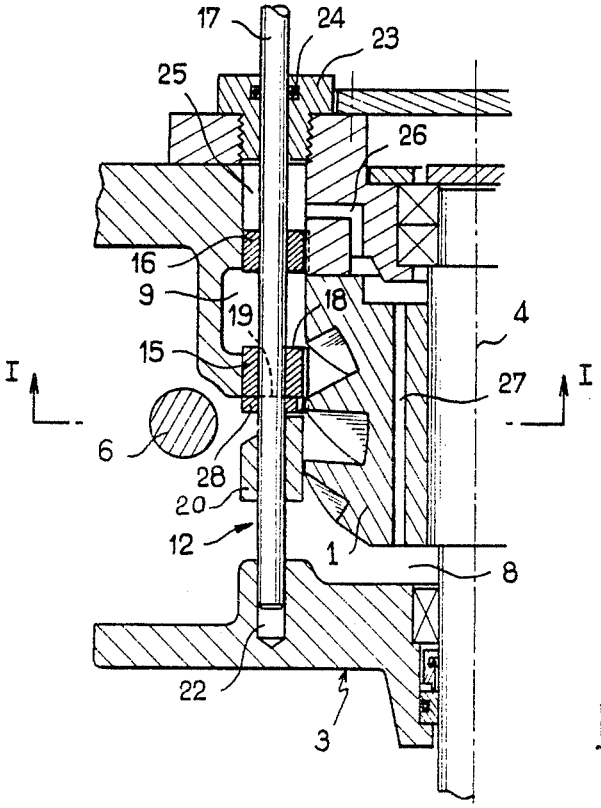
FIG. 2 is a sectional part view along II—II of FIG. 1.

Referring to FIGS. 1 and 2, a compressor with hour-glass screw comprises a screw 1 with a cylindrical outer profile mounted inside a cylindrical cavity 2 of a casing 3 in order to rotate around an axis 4 by means of prime movers, typically motors (not represented). Such screw meshes with a pinion-wheel 5 mounted on a shaft 6 rotating freely on bearings 7.

At its lower extremity (on FIG. 2), the screw is connected with an intake cavity 8 itself connected to an inlet of the compressor, while at its upper extremity, the screw is connected with an exhaust cavity 9 connected to an outlet of the compressor.

When the screw 1 is rotated, it drives the pinion-wheel 5, and each time a tooth of the pinion-wheel comes into mesh with a thread of the screw, a certain amount of gas taken from the cavity 8 is captured in a chamber formed by the flanks of two adjacent threads of the screw, one face of said tooth, and the cylindrical wall 2 of the casing, which cooperates with the screw.

While the tooth continues its travel, the volume of this chamber decreases and compresses the gas, until this chamber registers with a triangular exhaust port 11 (FIG. 6) provided through the casing and connected with the exhaust cavity 9.

A slide (or slide valve) 12 is slidably mounted inside a groove 13 of the casing parallel to the axis of the screw. This slide has a face 14 cut along the same cylinder as the cavity 2 of the casing cooperating with the screw, in order to ensure the continuity of said cavity. Practically, to ensure this continuity, the cylindrical cavity 2 is machined after the slide has been mounted in its groove.

Figure 3:
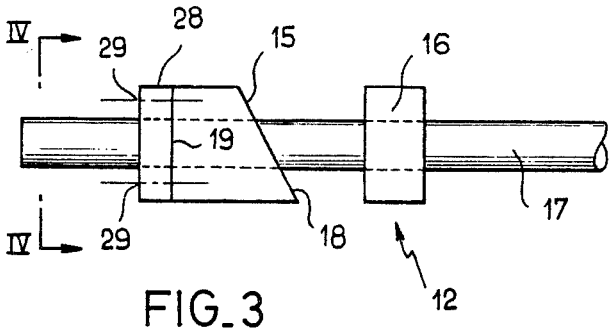
FIG. 3 is a view of the slide only, along III—III of FIG. 1.
Figure 5:
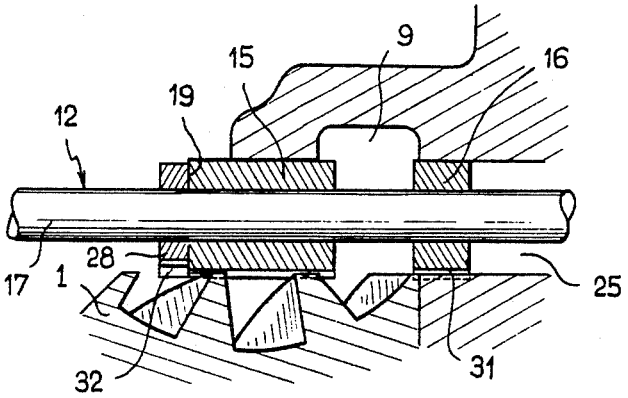
FIG. 5 is an enlarged part view of FIG. 2.

The slide 12 comprises two main parts 15, 16 (see also FIGS. 3 and 5) secured onto a cylindrical rod 17, or integral with this rod. One of the extremities 18 of the part 15 is cut obliquely to be in line with the edge of the triangular exhaust port 11. The other extremity 19 of the part 15 is nearly perpendicular to the axis of the rod 17.

The part 16 is located so that once the slide is assembled, it should obturate the groove 13 in order to isolate the exhaust cavity 9 (FIG. 2).

The rod 17 is slidably mounted at one end inside a recess 22 machined in the casing and at the other end through a removable nut 23 provided with a seal 24. The rod 17 also rests on an intermediary race machined in a boss 20 of the casing.

Thus, it is easy to assemble and eventually replace the slide just by taking off the nut 23.

This arrangement provides a cavity 25 (FIG. 2) between the nut and the part 16, and this cavity is connected with the intake cavity 8 by a conduit 26 made in the casing and an axial conduit 27 made through the screw in order to balance the axial thrust on the slide.

Figure 4:
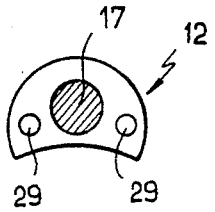
FIG. 4 is a sectional view along IV—IV of FIG. 3.

A spacer 28 (FIGS. 3 and 4) having the same outer profile as the part 15 is slid on the rod 17 and secured onto the face 19 of part 15 by screws 29. The axial thickness of the spacer 28 is calculated with respect to considerations which will be developed hereinafter in the explanation related to operation of the machine.

Figure 6:
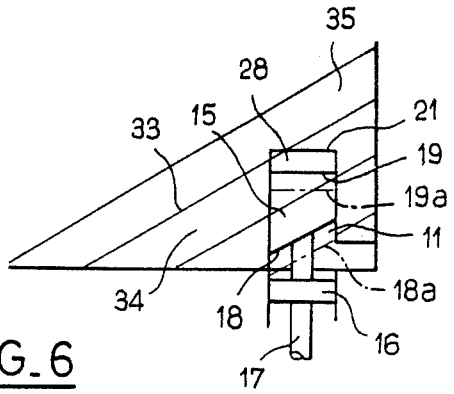
FIG. 6 is a schematic part view along III—III of FIG. 1, showing the cooperation of the slide with the exhaust port, and stretched along a part of the perimeter of the screw.

In normal operation, the slide 12 is positioned as shown in FIG. 6, i.e. with the main part 15 (provided with the spacer 28) abutting against the extremity 21 of the groove 13. Thus, the oblique extremity 18 is at the level of the oblique edge of the exhaust port 11.

If it is desired to increase the compression ratio, one has to delay the instant of exhaust by displacing the extremity 18*a*, which, more precisely delays the moment when the abovedescribed compression chamber registers with the exhaust port, thus increasing the compression ratio.

At that point, it will be noted that slight displacements of the edge 18 are sufficient to result in substantial variations of the compression ratio. For instance, in the example of a 240 mm diameter screw, a displacement of approximately 18 mm is sufficient to increase the compression ratio from 3:1 to 5:1 whereas the main part 15 of the slide usually has a length of the order of 70 to 80 mm.

But, at the same time, the edge 19 of the main part 15 has travelled to 19*a* and the edge of the spacer 28 which is directed away from main part 15 has made the same travel, leaving a cavity between this edge and the bottom 21 of the groove. This produces a partial back-flow of gas towards the intake and reduces the volumetric capacity of the compressor.

To avoid this effect, the spacer 28 is, according to the invention, replaced by another thicker spacer, its thickness being the same as the distance between 19*a* and 21.

If the slide was a known one made in one single part, i.e. without the possibility of associating a variable spacer to the main part 15, the only possible way to modify the compression ratio without affecting the volumetric capacity of the compressor, would be to change the slide so as to mount another one provided with a longer main part 15. But this new slide would not cooperate with the screw with the same precision as the original slide, machined in situ. Indeed, the manufacturing tolerances of the depth of the groove, of the slide diameter and of the distance between axes of the screw and the groove, are cumulative. This leads to providing a distance of nearly 0.2 to 0.3 mm in order to avoid contact between the screw and the groove, whereas the desirable clearance between the screw and the casing should rather be of the order of 0.1 to 0.15 mm. It would result in a substantial deterioration of the efficiency of the compressor.

The method in accordance with the invention consisting in the use of an interchangeable spacer cancels this drawback. Indeed, the spacer does not require the same machining accuracy as the other parts of the slide.

As a matter of fact, the most damaging leak is that occuring through the clearance 31 (FIG. 5) between the casing and the part 16, since the high pressure of the cavity 9 prevails on one side and the low pressure of cavity 25 on the other side.

The other leaks are those occurring between the slide and the crests of the threads of the screw, and which are more particularly linked to the clearance 32 (FIG. 5) between the spacer and these crests. The machanism of these leaks will be more readily understood by referring to FIG. 6 where the threads of the screw such as 33, stretched, have been schematically represented in oblique lines. It will be noted that the clearance 32 between the spacer 28 and the crest of the thread 33 generates a leak from the groove of the thread 34 to the groove of the thread 35, but this last groove is already isolated from the intake so that the leak merely results in recompression work, which here is negligible as it occurs during the initial phase of compression, therefore at low pressure.

It is thus verified that it is not necessary to machine the spacer 28 with the same precautions as with the remainder of the slide.

The invention is not of course limited to the abovementioned example but covers any technological alternative accessible to the man of art.

I claim:

1. A volumetric machine, comprising an hour-glass screw having a cylindrical outer profile, rotatably mounted inside a leak-tight cylindrical casing and engaging a plane pinion-wheel in order to create chambers with a variable volume, each of said chambers being defined by walls of two consecutive threads, an inner wall of the casing and one face of one tooth of the pinion-wheel; one low pressure port provided through the casing near one end of the screw; one high pressure port provided near the other end of the screw; and means for varying the capacity of the machine at a substantially constant volumetric ratio, said capacity varying means comprising a slide flush with the wall of the casing and mounted in a groove of the casing parallel to the axis of the screw, so as to vary the high pressure port, and to vary, remote from the high pressure port, a recess communicating with the low pressure port, wherein the slide comprises a body which is adjacent the high pressure port and one spacer of predetermined thickness having substantially the same outer profile as the body and removably secured to the body at one end thereof directed towards the low pressure port, and means for removing and replacing said one spacer with another spacer of a different predetermined thickness, whereby movement of said slide including said one spacer of predetermined thickness varies the capacity of the machine at a first substantially constant volumetric ratio, and substitution in said slide of said other spacer of different predetermined thickness changes the volumetric ratio of the machine so that a slide including said other spacer varies the capacity of the machine at a substantially constant volumetric ratio different from said first substantially constant volumetric ratio.

2. A machine according to claim 1, wherein the slide includes a rod extending axially of the casing and protruding from the body at the end thereof adjacent said one spacer, and wherein said one spacer has a bore receiving the rod.

* * * * *